United States Patent [19]

Amati

[11] Patent Number: 4,780,222

[45] Date of Patent: Oct. 25, 1988

[54] COMPOSITIONS CONTAINING PHOSPHORIC ACID PARTIAL ESTERS USEFUL FOR FATTING TANNED LEATHER

[75] Inventor: Werner Amati, Hersberg, Switzerland

[73] Assignee: Sandoz Ltd., Basel, Switzerland

[21] Appl. No.: 13,762

[22] Filed: Feb. 12, 1987

Related U.S. Application Data

[63] Continuation of Ser. No. 767,110, Aug. 19, 1985, abandoned.

[30] Foreign Application Priority Data

Aug. 22, 1984 [DE] Fed. Rep. of Germany ..... 3430829

[51] Int. Cl.[4] ..... C14C 9/00; C14C 5/00

[52] U.S. Cl. ..... 252/8.57; 8/94.21; 8/94.22; 8/94.23

[58] Field of Search ..... 8/94.22, 94.23, 94.21; 252/8.57

[56] References Cited

FOREIGN PATENT DOCUMENTS 2105745 3/1983 United Kingdom .

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

A water soluble or water dispersible composition containing (a) at least one phosphoric acid partial ester ($b_1$) at least one mono- or di-($C_{2-3}$alkylene) glycol mono-($C_{1-4}$-alkyl) ether or at least one aliphatic $C_{4-6}$alcohol or a mixture thereof ($b_2$) mono- or diethylene glycol or a mixture thereof (c) at least one aromatic-free or aromatic-poor hydrocarbon oil, and (d) a water miscible alkanolamine, the phosphoric acid partial ester (a) being dispersed or dissolved in the mixture ($b_1$)+($b_2$)+(c), and component (a) being at least partially neutralized in salt form, with the proviso that the composition has a water content $\leqq 5\%$ by weight.

It is useful as fatting agent for fatting leather.

26 Claims, No Drawings

COMPOSITIONS CONTAINING PHOSPHORIC ACID PARTIAL ESTERS USEFUL FOR FATTING TANNED LEATHER

This is a continuation of application Ser. No. 767,110, filed Aug. 19, 1985, now abandoned.

The invention relates to water soluble or water dispersible compositions useful for fatting tanned leather in an aqueous medium, the compositions being water-free or having a low water content.

The present invention provides a water soluble or water-dispersible composition comprising (a) at least one phosphoric acid partial ester of formula I or II

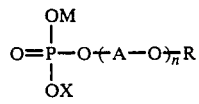

I or

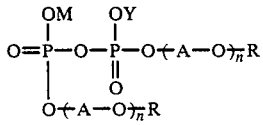

II where

M is H or an alkanolammonium cation derived from a water miscible alkanolamine (d)

X and Y, independently, are M or $-(A-O)_n-R$ each A, independently, is ethylene or 1,2-propylene each R, independently, is $C_{14-20}$alkyl, $C_{14-20}$alkenyl or a mixture thereof, and each n, independently, is a number from 2 to 10

($b_1$) at least one mono- or di-($C_{2-3}$alkylene) glycol mono-($C_{1-4}$alkyl) ether or at least one aliphatic $C_{4-6}$alcohol or a mixture thereof ($b_2$) mono- or diethylene glycol or a mixture thereof, and (c) at least one aromatic-free or aromatic-poor hydrocarbon oil, the phosphoric acid partial ester (a) being dispersed or dissolved in the mixture ($b_1$)+($b_2$)+(c), and component (a) being at least partially neutralised in salt form, with the proviso that the composition has a water content ≦5% by weight.

Examples of alkyl or alkenyl as R are tetradecyl, cetyl, oleyl, stearyl or a mixture of alkyl and/or alkenyl as present in technical mixtures of fatty alcohols, e.g. tallow fat alcohol. Preferably R is $C_{16-18}$alkyl or $C_{16-18}$alkenyl or a mixture thereof.

n is preferably a number from 2 to 6, more preferably from 3 to 5.

A is preferably ethylene.

In the composition of the invention, the phosphoric acid partial ester is at least partially neutralised in salt form with alkanolamine (d). Component (a) is present as a partial salt with an alkanolamine (d). Suitable alkanolamines (d) include mono-, di- or tri-(β- or γ-hydroxy-$C_{2-3}$alkyl) amines and N($C_{1-2}$alkyl)-N-(β- or γ-hydroxy-$C_{2-3}$alky)amines. Preferred alkanolamines (d) are mono-, di- or triethanolamine, mono- di- or triisopropanolamine or methylethanolamine, particularly monoethanolamine, triethanolamine and diisopropanolamine.

Suitable aliphatic $C_{4-6}$alcohols as or present in component ($b_1$) include linear or branched $C_{4-6}$-alkanols and -diols. Preferred alkanols are n-butanol, isoamyl alcohol and isohexanol, preferred alkanediols are tetramethylene glycol, pentamethylene glycol, 1,6-hexanediol, 1,3-butanediol, 2,3-butanediol, 2,5-hexanediol and 2-methyl-2,4-pentanediol, the latter being a particularly preferred diol. Preferred alkylene glycol monoalkylethers as or present in component ($b_1$) are diethyleneglycol and monopropylene glycol mono-($C_{1-4}$alkyl) ethers, particularly the methyl, ethyl or n-butyl ether of diethyleneglycol Component ($b_1$) is preferably a $C_{4-6}$alkanol, a $C_{4-6}$alkanediol or a diethyleneglycol mono($C_{1-4}$alkyl) ether, more preferably such as indicated above for the preferred significances or a mixture thereof.

Component ($b_2$) is preferably monoethylene glycol or a mixture of mono- and diethylene glycol containing predominantly mono-ethylene glycol (>50% by weight).

In the mixture ($b_1$)+($b_2$), ($b_2$) advantageously amounts at least to 60% by weight, preferably to 65–90% of said mixture.

Component (c) may be a natural, semi-synthetic or synthetic hydrocarbon oil that is liquid at room temperature (20° C.), preferably component (c) is a non-fatting hydrocarbon oil which has an aromatic content <20% by weight. Preferably the hydrocarbon oils (c) have a boiling range <250° C.

Preferred oils (c) are the hydrocarbon oils from refining crude petroleum (mineral oils), particularly the followings:

1. Hydrocarbons from petroleum refining (boiling range from 65° to 140° C.) which are aromatic-free or have an aromatic content <20% by weight.
2. White spirits, paint thinners having a boiling range from 100° to 250° C., preferably from 140° to 250° C.; preferably those in Table 1.

TABLE 1

| % aromatic content | b.p. °C. in the range |
|---|---|
| aromatic-free | 100–250°, preferably 140–250° |
| 12–19% | 160–210° |

3. Isoparaffins, b.p. in the range from 110° to 250° C. (aromatic-free)
4. Paraffin oils (=mineral oils) e.g. diesel oil, spindle oil, machine oil, cylinder oil, lubricating oil, medicinal paraffin oil.

Particularly preferred hydrocarbon oils are the aromatic free hydrocarbons from petroleum refining (b.p. 80°–110° C.) and aromatic-free white spirits (b.p. 150°–250° C.), more preferably the aromatic-free white spirits, especially those having a boiling point in the range 200°–250° C.

The composition of the invention advantageously contains for every 100 parts of component (a) (calculated in the non-neutralised form) from 30 to 100 parts of component (c), preferably from 30 to 65, particularly from 30 to 50 parts of component (c), the parts being parts by weight. Components ($b_1$)+($b_2$) are advantageously present in an amount of from 15 to 120 parts by weight for every 100 parts of component (a) (in the free acid form).

Component ($b_1$) is advantageously present in the composition of the invention in an amount ranging from 12 to 50% by weight, preferably from 15 to 25% by weight of component (a); component ($b_2$) advantageously amounts to 50–250% by weight, preferably 80–250%, by weight, particularly 100–250% by weight of (c).

Component (d) is advantageously present in such an amount that an aqueous dilution of 100 g of the composition in one liter has a pH of 6–9, preferably 6.5–8.5.

According to a further embodiment of the invention, the composition may also contain urea, for example in an amount up to 20% by weight of component (a).

When the composition of the invention contains urea, the water content of the resulting composition is advantageously at most 4% by weight. Preferably the composition of the invention only contains water when urea is present, the water content of the composition being from 1 to 4% by weight; in such a case the urea is advantageously present in an amount of from 50 to 200% by weight of the water amount.

Preferably the composition of the invention is water-free; the composition of the invention is preferably also free from urea.

Preferred compositions of the invention contain 100 parts by weight of component (a) calculated as the free acid 12–50 parts by weight of component ($b_1$)

50–250% by weight, based on the weight of (c), of component ($b_2$)

30–100 parts, preferably 30–65 parts, by weight of component (c)

an amount of component (d) as required to obtain a pH of 6–9 as indicated above up to 4% by weight of water based on the total weight of the composition, and up to 20 parts by weight of urea, component ($b_2$) being preferably at least 60% by weight of the total weight $(b_1)+(b_2)$.

Further preferred compositions of the invention contain 100 parts by weight of component (a) calculated as the free acid 15–25 parts by weight of component ($b_1$)

80–250% by weight, preferably 100–250% by weight, based on the weight of (c), of component ($b_2$)

30–50 parts by weight of component (c)

an amount of compound (d) as required to obtain a pH 6.5–8.5 as indicated above

<1% by weight based on the total weight of the composition of water, preferably 0%, and up to 20 parts by weight, preferably 0%, of urea, component ($b_2$) being preferably present in an amount from 65 to 90% by weight of the total weight $(b_1)+(b_2)$.

The phosphoric acid partial esters (a) may be prepared according to known methods, for example by reacting an ethoxylated saturated or unsaturated $C_{14-20}$alcohol with phosphorous pentoxide, phosphorus oxychloride or polyphosphoric acid, preferably with phosphorus pentoxide.

The composition of the invention may be prepared according to known methods, e.g. by mixing of the components. It is preferred to add first component (c) to the melted phosphoric acid partial ester (a) and then the remaining components, component ($b_2$) being preferably added at the end. According to another alternative, component (a) is added in the melted form to a mixture of the other components.

When admixed with the other components, particularly component (c), component (a) is added at a temperature from 40° to 100° C., preferably 50° to 90° C.; it may be possible to use the heat developed when component (a) is neutralised with component (d).

The composition of the invention are particularly stable to storage even when stored for a long period at various temperatures, e.g. from −10° C. to +80° C. for several weeks. They are obtained in a viscous form and are also frost resistant.

The compositions of the invention are useful as fatting compositions for the fatting of tanned leather from an aqueous medium.

Accordingly, the invention also provides a method for fatting a tanned leather substrate comprising applying to the substrate as the fatting agent an aqueous solution or dispersion of the composition as defined above. According to a preferred embodiment of the fatting method the fatted leather is post-treated with a polyvalent metal cation or oxymetal cation.

The compositions of the invention are readily diluted with water. Before use, they are conveniently diluted with water to stock preparations, advantageously in a weight ratio of composition to water of 1:1–5 preferably 1:1.5–3.

The fatting compositions of the invention are applied to leather acording to known fatting methods using an aqueous solution, e.g. by impregnation such as padding, spray or foam technique, or by exhaust, preferably by exhaust. The concentration of phosphoric acid partial ester (a) in the aqueous fatting bath based on the wet shaved weight of leather is advantageously from 0.2 to 15%, preferably from 2 to 8%. The aqueous fatting bath advantageously has a pH from slightly alkaline to acidic, preferably from 2 to 9, more preferably from 4 to 7. The pH adjustment may be carried out by the addition of an appropriate acid, base or buffer solution, preferably formic acid or ammonium or alkali metal carbonate. The preferred temperatures for fatting leather are from 20° to 70° C., more preferably from 40° to 60° C.

The fatted leather may be dried and finished according to known methods. The leather may be dyed before or after the fatting treatment according to the invention. Suitable dyestuffs include those usual for dyeing leather, preferably anionic, metal-free or metallised azo dyestuffs.

Suitable leather substrates are those which have been tanned, for example naturally tanned leather, combined tanned or synthetically tanned leather, for example chrome tanned, zirconyl tanned, aluminium tanned leather, or leather that is re-tanned.

Preferred leather substrates are grain leather, for example nappa from sheep or goat, box leather from calf or cow or cow hide or velours leather, preferably from sheep, goat or cow, and more preferably hunting leather, split velours from cow or calf skin and nubuk leather. Also fur velours may be treated.

Suitable polyvalent cations for the post-treatment of the fatted leather include magnesium, calcium, barium, aluminium, chromium and zirconyl cations, aluminium, chromium and zirconyl cations being preferred. They are used in the form of an oxide, hydroxide or salt. Water soluble salts of said cations are preferred, particularly aluminium sulphate, potassium alum, chromium (III) sulphate, potassium chromium alum, chromium hydroxy sulphate or zirconyl chloride, sulphate or acetate.

The concentration of the polyvalent metal cation-containing compound in the post-treatment bath is advantageously from 1 to 100%, preferably 5 to 20% by weight based on component (a). The treatment with the polyvalent metal cation-containing compound may be carried out by impregnation, e.g. padding or foam or spray technique, or preferably by exhaust, particularly from an aqueous medium. The treatment is advantageously carried out at a temperature from 20° to 70° C., preferably 40° to 60° C.; the pH of the treatment is advantageously adjusted from a slightly alkaline to an acidic pH value, particularly from 2 to 9, preferably 4–7. The pH adjustment may be carried out by the addition of an appropriate acid, base or buffer solution, e.g. as indicated above for the fatting treatment. The polyvalent metal cation-containing compound may be added to the fatting bath on termination of the fatting process using the same aqueous medium, an adjustment of the pH being then not necessary. After the post-treatment, the leather may be finished according to known methods.

Leather when treated according with the invention using a composition of the invention, optionally post-treated with a polyvalent cation, shows a high hydrophobicity and good tear resistance. It is supple and has a good handle, it also has good fastness properties related to leather, particularly fastness to dry cleaning.

The following Examples illustrate the invention. All parts and percentages are by weight and all temperatures in degrees Centigrade, unless otherwise indicated.

EXAMPLE 1

260 g Tallow fat alcohol and 0.5 g pulverised sodium hydroxide are placed in a 1.5 l four-necked flask and heated to 150°. The flask is evacuated and then filled with 167 g ethylene oxide at normal pressure and at a temperature of 150°–190°. At the end of the reaction the flask is flushed with nitrogen and cooled to 60°. 71 g of phosphorous pentoxide are added portionwise at 60°. After the addition, the reaction mixture is left to react for 6–8 hours at 60° C.

200 g of the phosphoric partial ester as obtained above and 70 g of an odourless aromatic-free white spirit (boiling range from 201°–243° ) are introduced in a 750 ml four-necked flask and heated to 60°–70°. To the resulting clear brown solution there is added dropwise 30 g monoethanolamine in the course of 30 minutes, whereby the temperature rises to 85°–90°. The mixture is then diluted with 40 g diethylene glycol monomethyl ether, 10 g diethylene glycol and 150 g monoethylene glycol, the temperature being maintained within 60° to 80°. After cooling to 50°, the mixture is discharged in the form of a viscous liquid.

EXAMPLES 2 to 5

By following the procedure as disclosed in Example 1 but using the compounds listed in Table 2 below in the indicated amount the following compositions can be prepared.

TABLE 2

| | Ex. 2 | Ex. 3 | Ex. 4 | Ex. 5 |
|---|---|---|---|---|
| Phosphoric partial ester as in Example 1 | 40% | 40% | 40% | 40% |
| White spirit as in Example 1 | 14% | 14% | 14% | 14% |
| Monoethanolamine | — | — | 6% | 6% |
| Triethanolamine | 14% | 14% | — | — |
| 1-butanol | 8% | — | — | — |
| 2-methyl-2-butanol | — | 8% | — | 8% |
| Diethyleneglycol monomethyl ether | — | — | 8% | — |
| Monoethyleneglycol | 24% | 24% | 32% | 32% |

EXAMPLE 6

30 g Monoethanolamine, 30 g hexylene glycol, 70 g white spirit (as in Example 1), 120 g ethyleneglycol, 20 g demineralised water and 30 g urea are introduced in a flask and heated to 60° until a clear solution is obtained. 200 g of the phosphoric partial ester as obtained in Example 1 and heated to 60° are added dropwise to the above clear solution, whereby the temperature raises to 80°–90°. The resulting mixture is stirred until homogeneous. After cooling a paste-like composition is obtained.

EXAMPLES 7 to 14

By following the procedure as disclosed in Example 6 but using the compounds listed in Table 3 below in the indicated amount, the following compositions are obtained.

TABLE 3

| | Ex. 7 | Ex. 8 | Ex. 9 | Ex. 10 | Ex. 11 | Ex. 12 | Ex. 13 | Ex. 14 |
|---|---|---|---|---|---|---|---|---|
| Partial phosphoric ester as in Ex. 1 | 40% | 40% | 40% | 40% | 40% | 40% | 40% | 40% |
| White spirite as in Example 1 | 24% | 20% | 16% | 18% | 20% | 26% | 18% | 16% |
| Monoethanolamine | 6% | 6% | 6% | 6% | 6% | 6% | 6% | 6% |
| Hexyleneglycol | 6% | 6% | 6% | 8% | 8% | 6% | 6% | 6% |
| Ethyleneglycol | 14% | 18% | 26% | 18% | 20% | 16% | — | — |
| Diethyleneglycol | — | — | — | — | — | — | 24% | 26% |
| Urea | 6% | 6% | 6% | 6% | 6% | 6% | 6% | 6% |
| Demineralised water | 4% | 4% | — | 4% | — | — | — | — |

In the following Application Examples A to C all percentages used are with reference to the shaved weight of substrate treated unless otherwise indicated. The chromium hydroxy sulphate has a $Cr_2O_3$ content of 25%.

APPLICATION EXAMPLE A (Box leather from cow)

A piece of wet-blue leather is immersed in 200% water for 5 minutes at 40°. The piece is then treated for 30 minutes with 2% chromium hydroxy sulphate and 4% dimethylolethyleneurea, after which it is treated wih 6% mimosa extract and 1% of the dyestuff C.I. (Colour Index) Acid Brown 359 for 1 hour. Then 250% water at 40° and 0.3% of an 85% aqueous formic acid solution are added to the dyebath. The piece is then fatted for 45 minutes at 50° in a bath of 200% water and 12.5% of the paste of Example 1* having a 5% active substance content with respect of the wet shaved weight. After this the piece is immersed for 30 minutes in 2% chromium hydroxy sulphate and 0.3% of an 85% aqueous formic acid solution. The leather is washed with 200% water at 20°, after which the leather is hung over a horse to dry overnight.

*The 12.5% paste of Example 1 are first diluted with 25% water at 50° and then this mixture is added to the remaining 175% water at 50°.

Instead of using the composition of Example 1, 12.5% of the composition of Example 5 to 13 may be used.

APPLICATION EXAMPLE B (Hunting leather)

A wet-blue calf leather is immersed in 150% water at 30° and is re-tanned with 5% chromium hydroxy sulphate for 3 hours. The leather is then washed for 10 minutes with 200% water at 40°, after which the leather is immersed for 2 hours in a bath of 200% water at 35° adjusted to pH 6.5 to 7 with ammonium bicarbonate. The leather is then washed with 200% water at 35° for 10 minutes and then dyed with 3% of the dyestuff C.I. Acid Brown 126 and 1% of a 25% ammonia solution for 45 minutes.

After this, the leather is fatted with 200% water containing 20% of the composition of Example 4* (containing 8% active substance with respect to the wet shaved weight) at 45° for 1 hour. The leather is then treated with 2% chromium hydroxy sulphate and 2% of an 85% aqueous formic acid solution for 30 minutes. The hide is then hung to dry overnight.

*The 20% composition of Example 4 are first diluted with 40% water at 45° and then this mixture is added to the remaining 160% at 45°.

Instead of the composition of Example 4, the compositions of Example 6 or 14 are used in the same amount.

APPLICATION EXAMPLE C (Velours from sheep)

A piece of wet-blue sheep's leather is immersed for 1 hour in 800% water at 50° containing 2% of a 25% aqueous solution of ammonia. The leather is then re-tanned with 3% zirconyl sulphate after which the leather is treated with 600% water at 50° and 1% of a 25% aqueous solution of ammonia for 10 minutes. The leather is then dyed in a bath containing 4% of the dyestuff C.I. Acid Brown 303 for 60 minutes. The dyed leather is fatted with a bath of 200% water and 12.5% of the composition of Example 1 (having 5% active substance with respect to the wet shaved weight) for 60 minutes. After fatting the leather is treated with 2% chromium hydroxy sulphate and 2% of an 85% aqueous formic acid solution for 40 minutes after which the leather is hung to dry overnight.

Instead of the composition of Example 1, the compositions of Example 8 or 9 are used in the same amounts.

The procedures of the Application Examples A to C are repeated using any composition of the other Examples 1 to 14.

The resulting leather is supple, has good fastness properties related to leather in particular fastness to dry cleaning and shows good hydrophobic properties.

What is claimed is:

1. A water-soluble or a water-dispersible composition comprising (a) at least one phosphoric acid partial ester of formula I or II

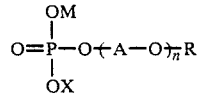

I or

-continued

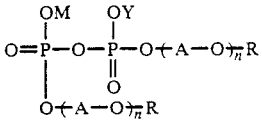

II where

M is H or an alkanolammonium cation derived from a water miscible alkanolamine (d)

X and Y, independently, are M or $+A-O)_nR$ each A, independently, is ethylene or 1,2-propylene each R, independently, is $C_{14-20}$alkyl, $C_{14-20}$alkenyl or a mixture thereof, and each n, independently, is a number from 2 to 10

($b_1$) at least one mono- or di-($C_{2-3}$alkylene) glycol mono-($C_{1-4}$alkyl) ether or at least one aliphatic $C_{4-6}$alcohol or a mixture thereof ($b_2$) mono- or diethylene glycol or a mixture thereof, and (c) at least one hydrocarbon oil having an aromatic content less than 20%, by weight, the phosphoric the phosphoric acid partial ester (a) being dispersed or dissolved in the mixture ($b_1$)+($b_2$)+(c), and component (a) being at least partially neutralized in the form of a salt of alkanolamine (d), said composition having a water content ≦5% by weight and containing, per 100 parts by weight (a) calculated in non-neutralized form, 12 to 50 parts ($b_1$), 30 to 100 parts (c) and an amount of ($b_2$) from 50 to 250% by weight of (c), with the proviso that the amount of ($b_2$) is at least 60% of the total weight of ($b_1$)+($b_2$).

2. A composition according to claim 1, in which in component (a) each n, independently, is a number from 2 to 6.

3. A composition according to claim 1, in which in component (a) each n is a number from 3 to 5.

4. A composition according to claim 1, in which component ($b_1$) is a $C_{4-6}$alkanol, a $C_{4-6}$alkanediol, diethyleneglycol mono($C_{1-4}$alkyl)ether or a mixture thereof.

5. A composition according to claim 1, in which component ($b_2$) is monoethylene glycol or a mixture of mono- and diethylene glycol containing >50% by weight of monoethylene glycol.

6. A composition according to claim 1, in which component (c) is a non-fatting hydrocarbon oil which has an aromatic content <20% by weight and a boiling range <250° C. or a mixture thereof.

7. A composition according to claim 1, in which component (c) is an aromatic-free hydrocarbon from petroleum refining or an aromatic-free white spirit.

8. A composition according to claim 1, in which component (d) is selected from mono- di- or tri-(β- or γ-hydroxy-$C_{2-3}$alkyl) amines and N-($C_{1-2}$alkyl)-N-(β- or γ-hydroxy-$C_{2-3}$alkyl)amines.

9. A composition according to claim 1 containing 100 parts by weight of component (a) calculated as the free acid 15–25 parts by weight of component ($b_1$)

80–250% by weight, based on the weight of (c), of component ($b_2$)

30–50 parts by weight of component (c)

an amount of compound (d) as required to obtain a pH 6.5–8.5 when 100 g of the compositions is diluted to one liter of water component ($b_2$) being present in an amount from 65 to 90% by weight of the total weight ($b_1$)+($b_2$).

10. A method for fatting a tanned leather substrate comprising applying to the substrate as the fatting agent an aqueous solution or dispersion of the composition as defined in claim 1.

11. A method according to claim 10, in which the fatted leather substrate is post-treated with a polyvalent metal cation or oxymetal cation.

12. A composition according to claim 1 wherein an alkanolamine (d) is present in an amount such as to give a pH of 6–9 when 100 g. of the composition is diluted to one liter with water.

13. A composition according to claim 1 wherein the total amount of components ($b_1$)+($b_2$) is 15 to 120 parts by weight per 100 parts of component (a) in free acid form.

14. A composition according to claim 12 wherein the total amount of components ($b_1$)+($b_2$) is 15 to 120 parts by weight per 100 parts of component (a) in free acid form.

15. A composition according to claim 1 containing up to 4% by weight water, based on the total weight of the composition, and up to 20%, based on the weight of component (a), of urea.

16. A composition according to claim 14 containing up to 4% by weight water, based on the total weight of the composition, and up to 20%, based on the weight of component (a), of urea, said amount of urea being 50 to 200% by weight of the amount of water.

17. A composition according to claim 1 which is water-free.

18. A composition according to claim 14 which is water-free.

19. A composition according to claim 18 which is free of urea.

20. A composition according to claim 1 wherein, in component (a), n is 2 to 6; component ($b_1$) is a $C_{4-6}$alkanol, a $C_{4-6}$alkanediol, a diethyleneglycol mono($C_{1-4}$alkyl) ether or a mixture thereof; component ($b_2$) is monoethylene glycol or a mixture of mono- and diethylene glycol containing more than 50% by weight of monoethylene glycol; component (c) is a non-fatting hydrocarbon oil having a boiling range below 250° C. or a mixture thereof and component (d) is selected from mono- di- or tri-($\beta$- or $\gamma$-hydroxy-$C_{2-3}$alkyl) amines and N-($C_{1-2}$alkyl)-N-($\beta$- or $\gamma$-hydroxy-$C_{2-3}$alkyl)amines.

21. A composition according to claim 14 wherein, in component (a), n is 2 to 6; component ($b_1$) is a $C_{4-6}$alkanol, a $C_{4-6}$alkanediol, a diethyleneglycol mono($C_{1-4}$alkyl) ether or a mixture thereof; component ($b_2$) is monoethylene glycol or a mixture of mono- and diethylene glycol containing more than 50% by weight of monoethylene glycol; component (c) is a non-fatting hydrocarbon oil having a boiling range below 250° C. or a mixture thereof and component (d) is selected from mono- di- or tri-($\beta$- or $\gamma$-hydroxy-$C_{2-3}$alkyl) amines and N-($C_{1-2}$alkyl)-N-($\beta$- or $\gamma$-hydroxy-$C_{2-3}$alkyl)amines.

22. A composition according to claim 21 which is water-free.

23. A method for fatting a tanned leather substrate which comprises applying to the substrate, as the fatting agent, an aqueous solution or dispersion of a composition according to claim 14.

24. A method according to claim 23 wherein the aqueous solution or dispersion has a pH of 2 to 9, a temperature of 20° to 70° C. and a concentration of component (a) of 0.2 to 15% based on the shaved weight of the leather substrate.

25. A composition according to claim 21 containing 100 parts by weight of component (a) calculated as the free acid 15–25 parts by weight of component ($b_1$)

80–250% by weight, based on the weight of (c), of component ($b_2$)

30–50 parts by weight of component (c)

an amount of compound (d) as required to obtain a pH 6.5–8.5 when 100 g of the composition is diluted to one liter of water, component ($b_2$) being present in an amount from 65 to 90% by weight of the total weight ($b_1$)+($b_2$).

26. A composition according to claim 25 wherein component (a) is a reaction product of phosphorous pentoxide with oxyethylated tallow fat alcohol, component ($b_1$) is diethylene glycol monomethyl ether, component ($b_2$) is a mixture of monoethylene glycol and diethylene glycol, component (c) is aromatic-free white spirit having a boiling range 201°–243° C. and component (d) is monoethanolamine.

* * * * *